US010493356B2

(12) United States Patent
Schlatter

(10) Patent No.: US 10,493,356 B2
(45) Date of Patent: Dec. 3, 2019

(54) CARD TILE DECK AND METHOD OF PLAYING A GAME USING THE SAME

(71) Applicant: Yellow Bridge Creek, LLC, Jeffersonville, IN (US)

(72) Inventor: Jason Schlatter, Jeffersonville, IN (US)

(73) Assignee: YELLOW BRIDGE CREEK, LLC, Jeffersonville, IN (US)

( * ) Notice: Subject to any disclaimer, the term of this patent is extended or adjusted under 35 U.S.C. 154(b) by 0 days.

(21) Appl. No.: 15/924,480

(22) Filed: Mar. 19, 2018

(65) Prior Publication Data

US 2018/0264350 A1 Sep. 20, 2018

Related U.S. Application Data

(60) Provisional application No. 62/473,025, filed on Mar. 17, 2017, provisional application No. 62/592,768, filed on Nov. 30, 2017.

(51) Int. Cl.
*A63F 9/20* (2006.01)
*A63F 1/02* (2006.01)
(Continued)

(52) U.S. Cl.
CPC ..... *A63F 1/02* (2013.01); *A63F 9/20* (2013.01); *A63F 11/0074* (2013.01); *A63F 2001/0475* (2013.01); *A63F 2001/0483* (2013.01); *A63F 2003/0088* (2013.01); *A63F 2003/00791* (2013.01); *A63F 2003/00876* (2013.01); *A63F 2003/00883* (2013.01);
(Continued)

(58) Field of Classification Search
CPC ..... A63F 2011/0086; A63F 2011/0083; A63F 11/0074; A63F 2003/00883; A63F 2003/0088; A63F 2003/00867; A63F 2003/00876; A63F 2003/00791; A63F 2001/0475; A63F 2001/0488; A63F 2001/0483; A63F 1/02; A63F 1/00; A63F 2009/062; A63F 2009/067; A63F 2009/0688; A63F 9/20
USPC ..... 273/292, 293, 294, 299, 302, 308
See application file for complete search history.

(56) References Cited

U.S. PATENT DOCUMENTS 3,245,687 A * 4/1966 Irwin ..... A63F 1/02 273/157 A
4,468,037 A * 8/1984 Kuhn ..... A63F 9/0613 273/295

(Continued)

FOREIGN PATENT DOCUMENTS

GB 519336 * 3/1940

*Primary Examiner* — Benjamin Layno
(74) *Attorney, Agent, or Firm* — James R. Hayne; Stites & Harbison PLLC

(57) ABSTRACT

A card tile deck includes a plurality of card tiles divided into multiple zones with each of the zones including either a first indicia, a second indicia, a third indicia, or a null indicia. A method of playing a game includes forming a build stack of played card tiles from the plurality of card tiles by repeatedly positioning an active card tile on top of a played card tile with one of the zones of the active card tile substantially overlapping one of the zones of the played card tile. A null indicia can be covered by either the first indicia, the second indicia, or the null indicia. The first indicia or second indicia can be covered by either the third indicia or the null indicia. A third indicia can be covered by the null indicia.

10 Claims, 9 Drawing Sheets

(51) Int. Cl.

| | |
|---|---|
| *A63F 11/00* | (2006.01) |
| *A63F 3/00* | (2006.01) |
| *A63F 1/04* | (2006.01) |
| *A63F 9/06* | (2006.01) |

(52) U.S. Cl.
CPC ... *A63F 2009/062* (2013.01); *A63F 2009/067* (2013.01); *A63F 2009/0688* (2013.01); *A63F 2011/0086* (2013.01)

(56) References Cited

U.S. PATENT DOCUMENTS

| | | | | |
|---|---|---|---|---|
| 4,867,455 | A | 9/1989 | Fritzman | |
| 6,971,649 | B2 | 12/2005 | Richardson et al. | |
| 2003/0184016 | A1* | 10/2003 | Miller | A63F 1/02 273/307 |
| 2005/0230911 | A1* | 10/2005 | Blake | A63F 3/02 273/236 |

* cited by examiner

CARD TILE DECK AND METHOD OF PLAYING A GAME USING THE SAME

CROSS-REFERENCE TO RELATED APPLICATIONS

This application claims priority to U.S. Provisional Patent Application No. 62/473,025, filed Mar. 17, 2017, and U.S. Provisional Patent Application No. 62/592,768, filed Nov. 30, 2017 the entire disclosures of which are incorporated herein by reference.

FIELD OF INVENTION

The present invention relates to a card tile deck including a plurality of card tiles having multiple zones and a method of playing a game using the same in which one card tile is positioned on top of other card tiles.

BACKGROUND OF THE INVENTION

Competitive turn based games are a well-known means of entertainment, and there is a constant interest in new games, especially a game that is easily portable. Accordingly, there is always a need for a new and exciting game.

SUMMARY OF THE INVENTION

The present invention is directed towards a card tile deck including a plurality of card tiles that are each divided into multiple zones with each of the zones including either a first indicia, a second indicia, a third indicia, or a null indicia. In one embodiment, each of the plurality of card tile has a square shape and is divided into four square zones with each corner of the card tile including one of the four zones so that the four zones substantially fill the entirety of the card tile. In another embodiment, plurality of card tiles having a substantially octagonal shape and is divided into a central zone and four peripheral zones which surround the central zone.

Regardless of the shape of the card tiles, in some embodiments of the present invention, for some of the card tiles, one or more of the zones further includes instructions, or mechanics, which are activated by rules specific to the indicia included in the zone with the mechanic.

A card tile deck of the present invention can include any number of card tiles, but in one particular embodiment, the card tile deck includes 48 card tiles with various combinations of indicia and mechanics included in one or more of the zones of each card tile. In some embodiments of the present invention, one or more card tiles of the card tile deck are unique in that the exact same combination and location of indicia and mechanics are not present in any other card tile of the same card tile deck. In some particular embodiments, every card tile of the card tile deck is unique. In other words, a card tile deck of the present invention can include any number of card tiles having any combination of indicia and mechanics without departing from the spirit and scope of the present invention.

One exemplary method of playing a game includes first placing a single card tile face up in the center of the play area to form the base of a Build Stack. The Build Stack is dynamic in that during play the Build Stack grows larger by players positioning card tiles on top of the Build Stack. Players then take turns positioning a card tile from the player's hand (i.e., an active card tile) on top of a previously played card tile which forms part of the Build Stack according to specific placement rules. Specifically, not all of the zones of the active card tile must overlap an underlying zone, as long as one zone of the active card tile overlaps one zone of a played card tile of the Build Stack, and the number of zones of the active card which do overlap zones of played card tiles must equal the number of played card tiles that the active card is positioned on top of. Likewise, the indicia located on the zone of the played card tile affects what indicia can be included in the zone of the active card tile. The mechanics, if present, are activated either when the zone including the mechanic is positioned on top of another zone or when a zone is being positioned on top of the zone including the mechanic. The winner is determined by counting each players' assigned indicia (e.g., red nails or green nails) visible on the Build Stack, remaining in the player's hand, and any penalty nails which the player received.

DETAILED DESCRIPTION

The present invention is directed to card tile deck including a plurality of card tiles and a method for playing a game using the same. As used herein, the term "card tiles" is used to indicate a substantially planar object having a negligible thickness as compared to the card tile's length and width such that, when two card tiles are stacked and offset, both card tiles remain substantially parallel. The term "card tile" can, in some instances, be used interchangeable with the more general term "card."

Referring first to FIGS. 1-4, which each show an exemplary card tile of a first exemplary card tile deck of the present invention in which each of a plurality of card tiles have a substantially square shape. With respect to FIG. 1, one exemplary card tile 101*a* is divided into four zones 111*a*, 112*a*, 113*a*, 114*a* having a square shape. In particular, each corner of the card tile 101*a* includes one of the four zones 111*a*, 112*a*, 113*a*, 114*a* and the four zones 111*a*, 112*a*, 113*a*, 114*a* substantially fill the entirety of the card tile 101*a*.

Figure 1:
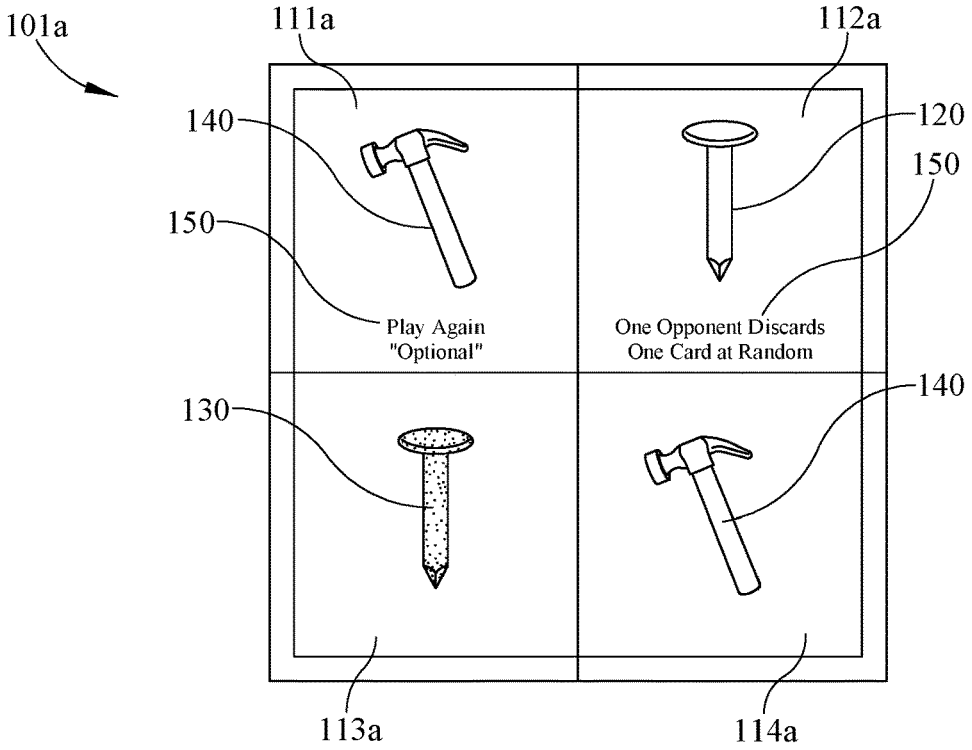
FIG. 1 is a plan view of one card tile of a first exemplary card tile deck of the present invention.
Figure 2:
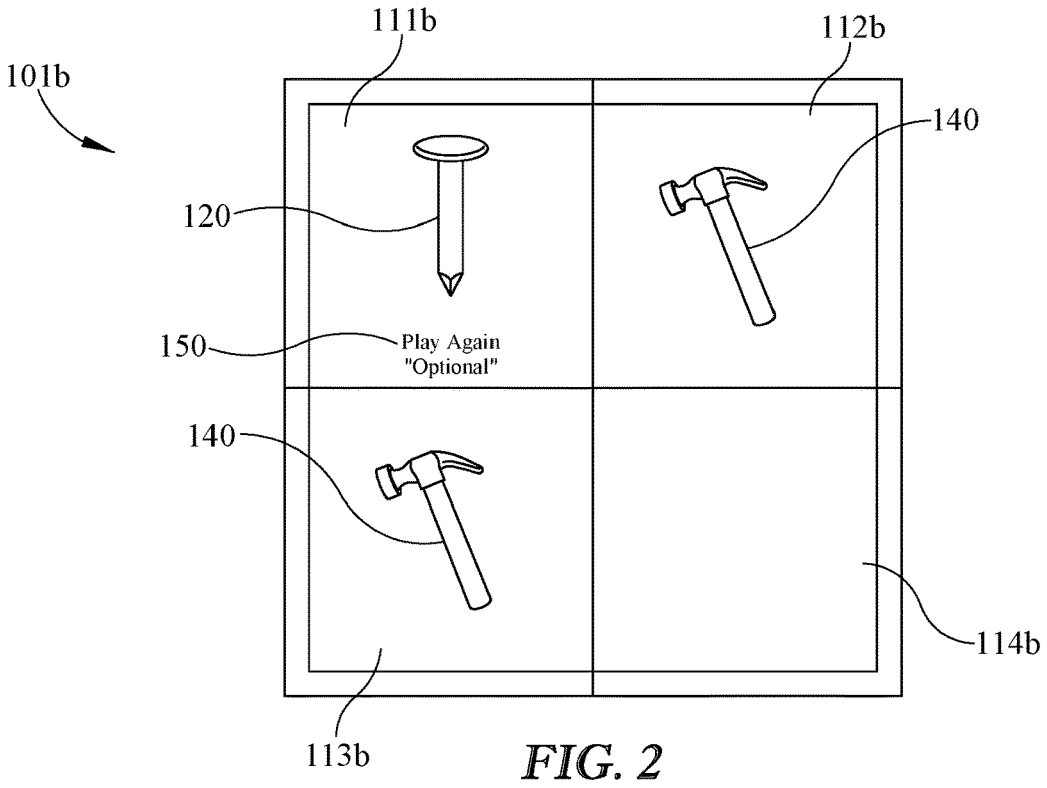
FIG. 2 is a plan view of another card tile of the first exemplary card tile deck of the present invention.
Figure 3:
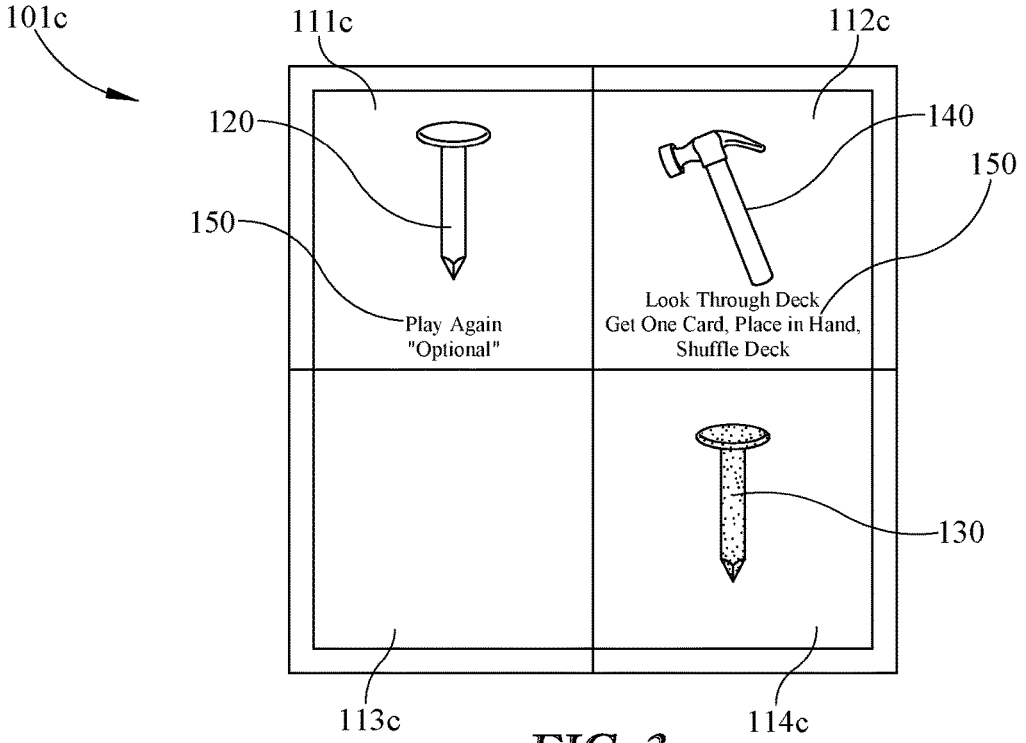
FIG. 3 is a plan view of another card tile of the first exemplary card tile deck of the present invention.
Figure 4:
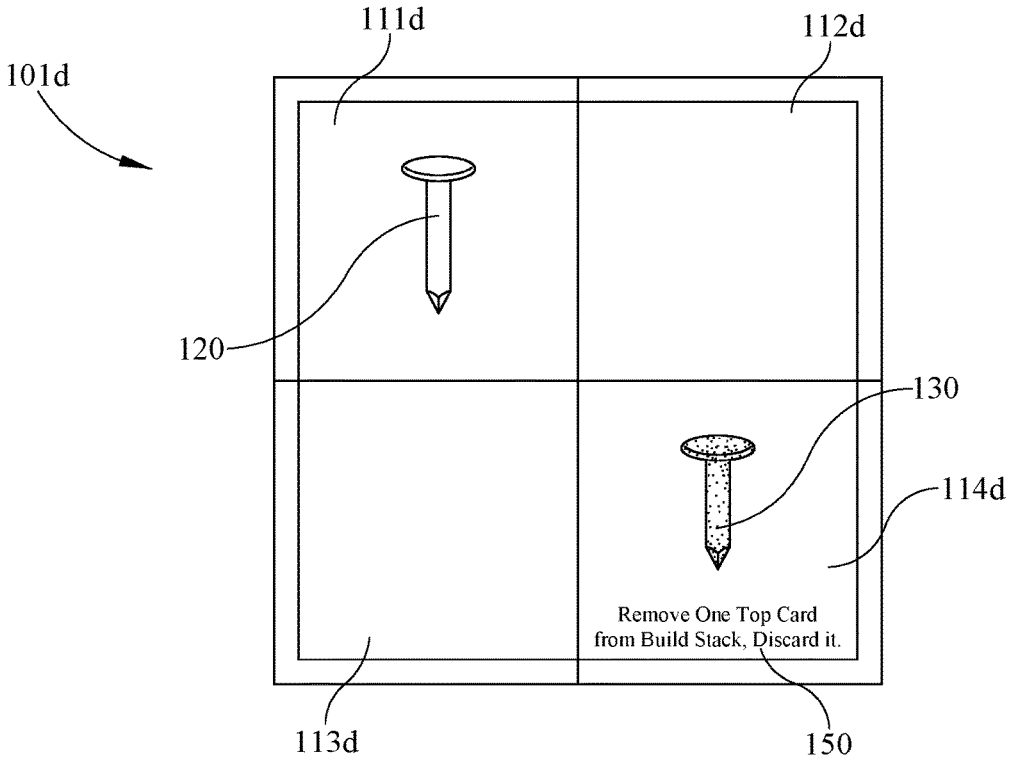
FIG. 4 is a plan view of another card tile of the first exemplary card tile deck of the present invention.

As shown in FIG. 1, each of the zones 111*a*, 112*a*, 113*a*, 114*a* of the exemplary card tile 101*a* includes either a first indicia 120, a second indicia 130, or a third indicia 140, however, as shown in FIGS. 2-4, one or more of the zones may include no such indicia (i.e., includes a null indicia). Of course, rather than including no indicia, it is contemplated that another symbol can be included as a null indicia. Such null indicia can, for example, be in the form of an "X" or other such symbol readily distinguishable from the first indicia, second indicia, and third indicia.

Referring still to FIG. 1 in particular, in this exemplary card tile deck, the first indicia 120 is a nail in a first color, such as red, the second indicia 130 is a nail in a second color, such as green, and the third indicia 140 is a hammer. The exemplary card tile 101*a* includes the first indicia 120 in a second zone 112*a*, the second indicia 130 in a third zone 113*a*, and the third indicia 140 in a first zone 111*a* and a fourth zone 114*a*.

As illustrated in FIGS. 1-4, the specific combination and location of the indicia included in the zones of the card tiles is not limited. In some exemplary card tile decks of the present invention, in a first subset of card tiles (e.g., the exemplary card tile 101*a* shown in FIG. 1), every one of the zones 111*a*, 112*a*, 113*a*, 114*a* includes either the first indicia 120, the second indicia 130, or the third indicia 140. In a second subset of card tiles (e.g., the exemplary card tile 101*b* shown in FIG. 2 and the exemplary card tile 101*c* shown in FIG. 3), one of the zones includes the null indicia while the other zones include either the first indicia 120, the second indicia 130, or the third indicia 140. In the exemplary card tile 101*b* shown in FIG. 2, the first zone 111*b* includes the first indicia 120, the second zone 112*b* includes the third indicia 130, the third zone 113*b* includes the third indicia 130, and the fourth zone 114*b* includes the null indicia (i.e., is blank). In the exemplary card tile 101*c* shown in FIG. 3, the first zone 111*c* includes the first indicia 120, the second zone 112*c* includes the third indicia 140, the third zone 113*c* includes the null indicia (i.e., is blank), and the fourth zone 114*c* includes the second indicia 130. In a third subset of card tiles (e.g., the exemplary card tile 101*d* shown in FIG. 4), two of the zones include the null indicia while the other zones include either the first indicia 120, the second indicia 130, or the third indicia 140. In the exemplary card tile 101*d* shown in FIG. 4, the first zone 111*d* includes the first indicia 120, the second zone 112*d* includes the null indicia (i.e., is blank), the third zone 113*d* includes the null indicia (i.e., is blank), and the fourth zone 114*d* includes the second indicia 130. Although not expressly shown, it is contemplated that in a fourth subset of card tiles, three of the zones include the null indicia (i.e., are blank) with the remaining zone including either the first indicia 120, the second indicia 130, or the third indicia 140, and in a fifth subset of card tiles every one of the zones include the null indicia (i.e., are blank).

Referring still to FIGS. 1-4, for some of the plurality of card tiles, one or more of the zones further includes instructions, or mechanics 150. In this exemplary card tile deck, the following mechanics 150, are included: Play Again "Optional;" Remove One Top Card From Build Stack, Discard it; Look Through Deck, Get One Card, Place in Hand, Shuffle Deck; Draw Two Cards "Optional;" Ø (Can't Be Covered); Next Player Must Cover a Green Nail; Next Player Must Cover a Red Nail; One Opponent Discards One Card at Random; and Discards One Card of Choice "Optional."

For example, and referring once again specifically to FIG. 1, the first zone 111*a* of the card tile 101*a* includes the mechanic 150—Play Again "Optional"—located underneath the third indicia 140, and the second zone 112*a* includes the mechanic 150—One Opponent, Discards One Card at Random—underneath the first indicia 120. In FIG. 2, the first zone 111*b* of the card tile 101*b* includes the mechanic 150—Play Again "Optional"—located underneath the first indicia 120. In FIG. 3, the first zone 111*c* of the card tile 101*c* includes the mechanic 150—Play Again "Optional"—located underneath the first indicia 120, and the second zone 112*c* includes the mechanic 150—Look Through Deck, Get One Card, Place in Hand, Shuffle Deck—located underneath the third indicia 140. In FIG. 4, the fourth zone 114*d* of the card tile 101*d* includes the mechanic 150—Remove One Top Card From Build Stack, Discard it—located underneath the second indicia 130.

The purpose and effect of these mechanics will be described in further detail below. Of course, the specific number, type, and location of the mechanics can vary without departing from the spirit and scope of the present invention. In particular, although each of the exemplary card tiles 101*a*, 101*b*, 101*c*, 101*d* shown in FIGS. 1-4 included one or more mechanics, not all card tiles of the card tile deck will necessarily include a mechanic.

FIGS. 1-4 show only four exemplary card tiles 101*a*, 101*b*, 101*c*, 101*d* of the card tile deck of the present invention. A card tile deck of the present invention can include any number of card tiles, but in one particular embodiment, the card tile deck includes 48 similarly configured card tiles with various combinations of indicia and mechanics included in one or more of the zones of each card tile. In some embodiments of the present invention, one or more card tiles of the card tile deck are unique in that the exact same combination and location of indicia and mechanics are not present in any other card tile of the same card tile deck. In some particular embodiments, every card tile of the card tile deck is unique. In other words, a card tile deck of the present invention can include any number of card tiles having any combination of indicia and mechanics without departing from the spirit and scope of the present invention.

Referring once again generally to FIGS. 1-4, in some embodiments of the present invention each of the exemplary card tiles further includes several additional features. Specifically, in some embodiments each card tile includes a border around the outer perimeter of the card tile which, during play, helps identify the edges of the card tile. In addition to the border, or as an alternative to the border, each card tile can include in each of its zones a unique card number (not shown). In this way, during play, it can readily be determined whether two adjacent zones are part of the same card tile (i.e., have the same unique card number) or are part of two different card tiles (i.e., each have a different card number), as further discussed below.

In some embodiments, an exemplary card tile deck of the present invention further includes player card tiles which are used to identify a particular player with a particular color corresponding to either the color of the first indicia (e.g., red nail) or the color of the second indicia (green nail).

In some embodiments, the exemplary card tile deck of the present invention further includes penalty card tiles which are used according to some exemplary implementations of the method of playing a card tile game of the present invention, as further discussed below.

In addition to the card tile deck, other game pieces can also be included within a game set of the present invention. Specifically, a timer (e.g., a 1 minute timer) can be included in the game set. Furthermore, other tokens or markers can be included within a game set of the present invention to help identify particular aspects of the game including, for example, a token which can be placed on a particular card or zone of a card tile to more readily identify the same. Furthermore, a rule book or other similar reference materials can also be included in order to assist players.

Turning now to an exemplary method of playing a game of the present invention, the game using an exemplary card tile deck is related to players taking turns constructing a dynamic build stack, or Build Stack, using card tiles in hand. In an exemplary embodiment, each of the players is assigned a color corresponding to either the color of the first indicia (e.g., red nail) or the color of the second indicia (e.g., green nail). The objective for each player is to end up with least number of their color indicia (nails) and place more their opponents color indicia (nails). In one embodiment, players have four card tiles in hand, play one card tile per turn, and draw or discard card tiles at the end of their turn to have four card tiles in their hand. The winner of the game is the player with the least amount of their color indicia (nails) at end of the game, including those visible on the Build Stack, in the player's hand, and any penalty card tiles.

Figure 7:
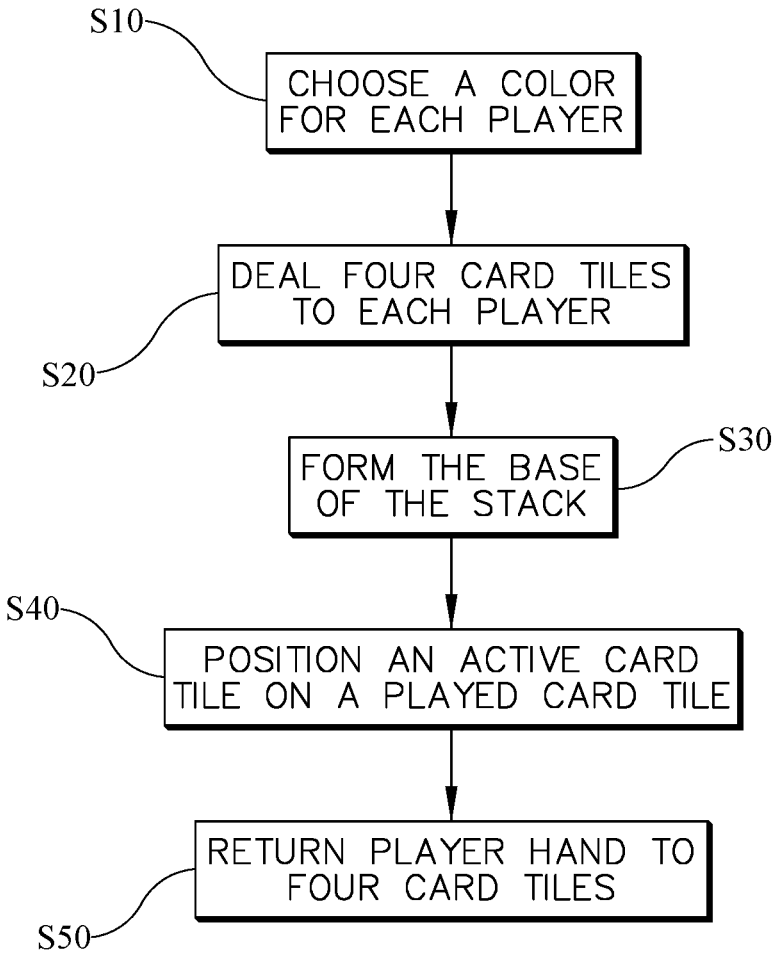
FIG. 7 is a flow diagram of an exemplary implementation of a method of playing a game of the present invention.

Referring now to FIG. 7, in a first step S10, players first choose a color corresponding to either the color of the first indicia (e.g., red nail) or the color of the second indicia (green nail). One such method of choosing colors includes each player drawing one card tile and the player with lowest number (i.e., the lowest unique card number) is the Dealer. The drawn card tiles are then placed back in the deck which is shuffled. In some exemplary embodiments, the player to the left of the Dealer, starts play with the order of play proceeding clockwise. With a two player game, players alternate taking turns. In some embodiments (e.g., under competitive play), turns are limited (e.g., one minute long) with the players enforcing the use of a timer.

In a step S20, four card tiles are dealt to each player and the remainder of the card tiles are placed face down off to the side of the play area to form a Draw Deck. Of note, a Discard Pile is formed during play, with the Discard Pile preferably rotated to be distinguishable from the Draw Deck.

Figure 5:
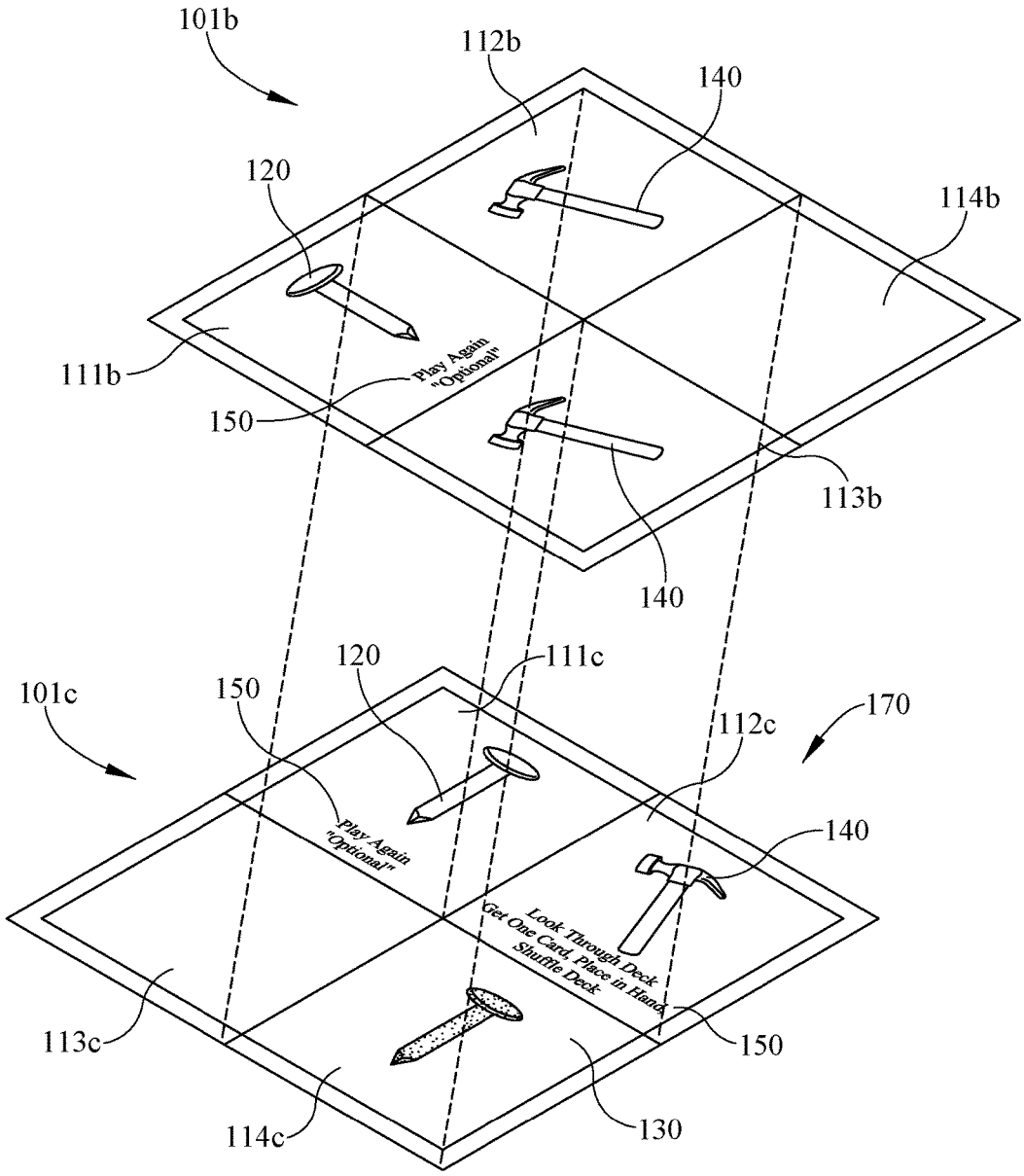
FIG. 5 is a perspective view of the card tile of FIG. 2 being positioned on top of a Build Stack formed from the single card tile of FIG. 3 according to an exemplary method of the present invention.

In a step S30, the top card tile of the Draw Deck is placed face up in the center of the play area to form the base of a Build Stack. For example, as shown in FIG. 5, a single card tile 101*c* forms the base of the Build Stack 170. The Build Stack is dynamic in that during play the Build Stack grows larger by players positioning card tiles on top of the Build Stack.

In a step S40, a player positions a card tile from the player's hand (i.e., an active card tile) on top of a previously played card tile which forms part of the Build Stack. For example, as shown in FIG. 5, an active card tile 101*b* is being positioned on top of the played card tile 101*c* with one of the zones 112*b* of the active card tile 101*b* substantially overlapping one of the zones 114*c* of the played card tile 101*d*. As illustrated in FIG. 5, the active card tile may be rotated by a player as needed to achieve a desired placement onto the Build Stack 170.

According to an exemplary implementation of the present invention, when the active card tile is positioned on top of the played card tile, only one zone of the active card tile overlaps only one zone of the played card tile. However, when the active card tile is positioned on top of a Build Stack formed of multiple played card tiles, each of the zones of the active card tile can overlap only one of the zones of one of multiple played card tiles forming the Build Stack. That is to say, one zone of the active card tile can cover only one zone of a played card tile on the Build Stack. Two zones of the active card tile can cover two zones, but each zone covered must be part of a separate card tile making up the Build Stack. Three zones of the active card tile can cover three zones, but each zone covered must be part of a separate card tile making up the Build Stack. Four zones of the active card tile can cover four zones, but each zone covered must be part of a separate card tile making up the Build Stack. In short, not all of the zones of the active card tile must overlap an underlying zone, as long as one zone of the active card tile overlaps one zone of a played card tile of the Build Stack, and the number of zones of the active card which do overlap zones of played card tiles must equal the number of played card tiles that the active card is positioned on top of.

Furthermore, according to an exemplary implementation of the present invention, if the one of the zones of the played card tile includes the null indicia, the one of the zones of the active card tile includes either the first indicia, the second indicia, or the null indicia. In other words, with respect to the particular indicia illustrated in FIGS. 1-6, blank zones can be covered by nails or other blank zones. If the one of the zones of the played card includes the first indicia or the second indicia, the one of the zones of the active card tile includes either the third indicia or the null indicia. In other words, with respect to the particular indicia illustrated in FIGS. 1-6, nails can be covered by hammers or by blank zones. If the one of the zones of the played card tile includes the third indicia, the one of the zones of the active card tile includes the null indicia. In other words, with respect to the particular indicia illustrated in FIGS. 1-6, hammers can only be covered by blank zones.

Figure 6:
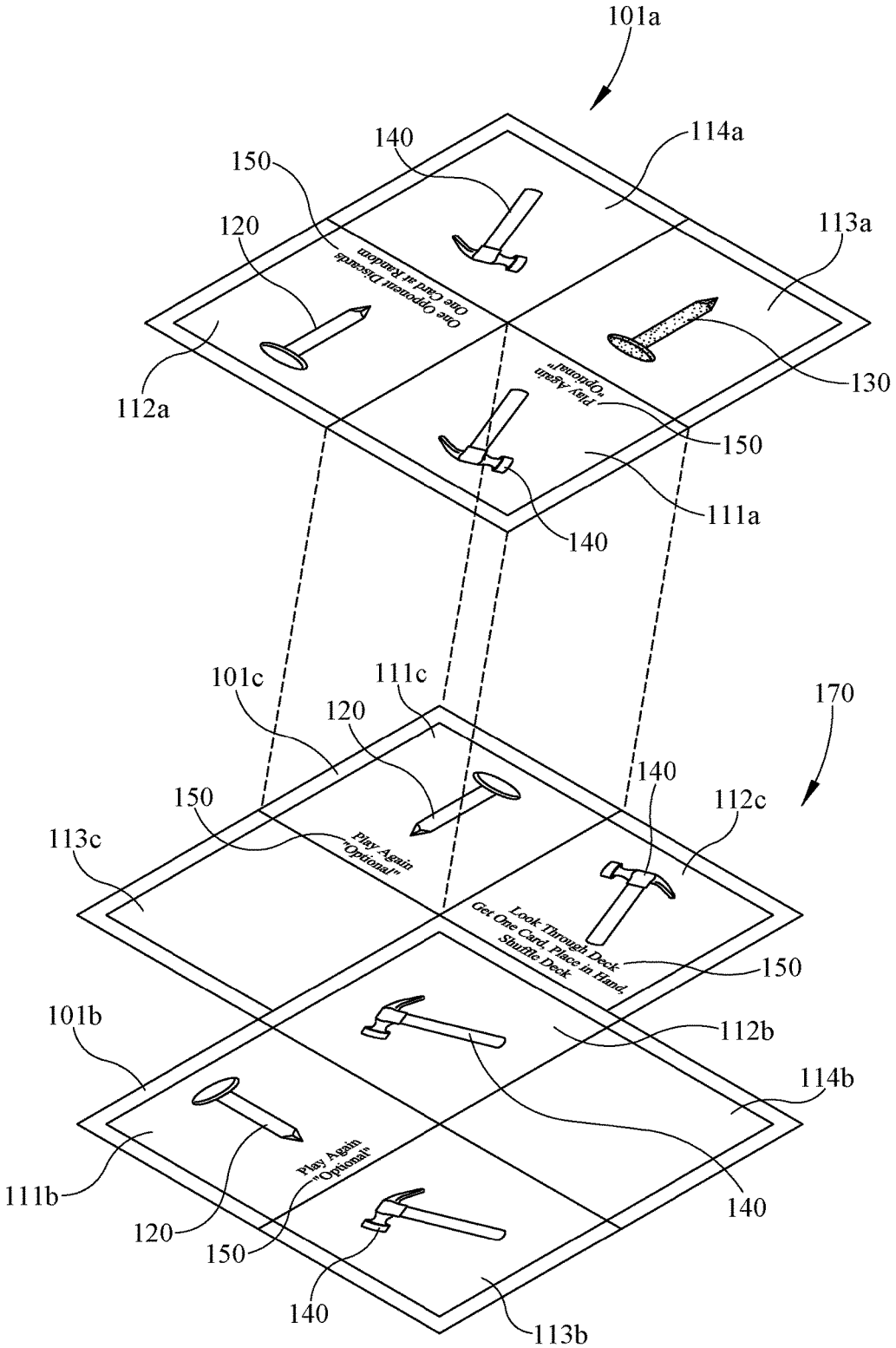
FIG. 6 is a perspective view of the card tile of FIG. 1 being positioned on top of the Build Stack formed from the card tiles of FIG. 2 and FIG. 3 according to an exemplary method of the present invention.

After the active card tile is positioned on top of the previously played card tile or card tiles, the active card tile becomes part of the Build Stack. For example, as shown in FIG. 6, the Build Stack 170 now consists of the two previously played card tiles 101*b*, 101*c*.

As previously mentioned, for some of the plurality of card tiles of the exemplary card tile deck, one or more of the zones further includes instructions, or mechanics. Each of the mechanics is activated, or used, according to rules specific to the indicia included in the zone with the mechanic. If the one of the zones of the played card tile includes mechanics, the additional actions are performed when the one of the zones of the active card tile is positioned on top of the one of the zones of the played card tile. In this instance, the instructions are only performed if the one of the zones of the played card tile includes the first indicia or the second indicia, and the instructions are not performed if the one of the zones of the active card tile includes the null indicia. If the one of the zones of the active card tile includes mechanics, the additional actions are performed when the one of the zones of the active card tile is positioned on top of the one of the zones of the played card tile. In this instance, the instructions are only performed if the one of the zones of the active card tile includes the third indicia, and the instructions are not performed if the one of the zones of the played card tile includes the null indicia. In other words, with respect to the particular indicia illustrated in FIGS. 1-6, mechanics included in a zone along with the first indicia 120 or the second indicia 130 (i.e., nails) are activated when covered by a zone of an active card tile which includes a third indicia 140 (i.e., a hammer). Mechanics included in a zone along with the third indicia 140 (i.e., a hammer) are activated when positioned on top of a zone of a placed card tile which includes the first indicia 120 or the second indicia 130 (i.e., nails). Of note, mechanics are not activated when covering a blank zone or when covered by a blank zone.

In a preferred embodiment, if during placement of an active card tile, a zone including a mechanic with the first or second indicia is covered by another zone including a mechanic with the third indicia, the mechanic associated with the first or second indicia is resolved first and the mechanic associated with the third indicia is resolved second. In other words, with respect to the particular indicia illustrated in FIGS. 1-6, nail mechanics resolve first and hammer mechanics resolve second. Likewise, placement of a single card tile on the Build Stack can, in some instances, activate multiple mechanics, but in all cases, all nail mechanics are resolved prior to resolving all hammer mechanics. Of note, all mechanics are considered "If Able," otherwise the mechanic is ignored. Certain mechanics are designated as "Optional" which means a player may use the mechanic, however is not required to do so.

After the current player has placed the active card tile on the Build Stack and all mechanics have resolved, in a step S50, the current player draws additional card tiles or discards card tiles to return the player's hand to four card tiles. Typically, a player places only one card tile per turn and would thus draw only one card tile from the Draw Deck. However additional play may be granted by mechanics and the player would then have to draw card tiles from the Draw Deck until the player's hand has four card tiles. Likewise, due to other mechanics, the player may have more than four card tiles in hand, in which case, the player must discard card tiles from the player's hand until there are four card tiles remaining the player's hand.

With respect to drawing card tiles, a player only draws card tiles at the end of the player's turn, unless otherwise specified by a mechanic.

With respect to discarding card tiles, the card tiles discarded are of the player's choice, unless otherwise specified by a mechanic. When discarding a card tile, a player must discard the card tile face down into the Discard Pile. As previously mentioned, the Discard Pile is preferably rotated to be distinguishable from the Draw Deck.

After the current player declares end of turn, the next player begins their turn and steps S40 and S50 are repeated. For example, as illustrated in FIG. 6, a second active card tile 101*a* is being positioned on top of the first played card tile 101*c* with one of the zones 111*a* of the active card tile 101*a* substantially overlapping one of the zones 111*c* of the played card tile 101*c*. Of note, the first zone 111*c* of the played card tile 101*c* includes a mechanic 150 along with the first indicia 120 (i.e., nail) and therefore the mechanic 150 is activate when covered by the zone 111*a* of the active card tile 101*a* with the third indicia 140 (i.e., hammer). Likewise, the first zone 111*a* of the active card tile 101*a* includes a mechanic 150 along with the third indicia 140 (i.e., hammer) and therefore the mechanic 150 is activated when positioned on top of the zone 111*c* of the played card tile 101*c* with the first indicia (i.e., nail). Thus, the move illustrated in FIG. 6 would result in activating both mechanics and the player will have the option to "Play Again" twice.

A round consists of all players taking a turn. Once all card tiles from the Draw Deck have been drawn, players continue to position a card tile from the player's hand on top of the Build Stack according to step S40 with the player's turn ending without drawing additional card tiles. The Game enters its final round when there are no card tiles left in the Draw Deck and one player has no card tiles left in hand at the end of the player's turn, as described further below Each of the mechanics included in the exemplary card tile deck of the present invention will now be described in detail.

Play Again "Optional": The current player who activates this mechanic may place an additional card tile this turn.

Remove One Top Card From The Build Stack, Discard it: If able, the current player who activates this mechanic must remove one card tile from the top of the Build Stack and discard it, a card tile is considered top of the Build Stack if it has no other card tiles above it. The card tile placed which activates this mechanic cannot be removed as part of this action.

Look Through Deck, Get One Card, Place in Hand, Shuffle Deck: The current player who activates this mechanic may look through the Draw Deck and retrieve one card tile of their choice. The player then places the selected card tile in their hand and shuffles the Draw Deck.

Draw Two Cards "Optional": The current player who activates this mechanic may draw two card tiles.

Ø (Can't Be Covered): The zone with this symbol can't be covered on the Build Stack by any other zone above it.

Next Player Must Cover a Red/Green Nail: The next player, if able, must cover a red or green nail (depending on which is specified by the mechanic) either using a hammer or a blank zone. In the event the next player states they cannot cover a red/green nail, the player who activated the mechanic can challenge them, as further discussed below.

One Opponent Discards One Card at Random: The current player who activates this mechanic picks one opponent and that opponent discards a card tile at random. The opposing player shuffles their card tiles face down and the current player picks one, places it face down in to the Discard Pile and does not view the card tile.

Discards One Card of Choice "Optional": The current player who activates this mechanic may discard one card tile from their hand and places it into the Discard Pile face down.

Of course, it is contemplated that additional mechanics can also be included or one or more of the follow mechanics can be excluded in other embodiments of the present invention. Furthermore, it should be understood that the above references to hammers and nails relate only one exemplary embodiment of the card tiles of the present invention, and the mechanics can similar be used for any indicia.

As mentioned above, Penalties may occur during the Next Player Must Cover a Green/Red Nail Mechanic. In the event the next player states they cannot cover the designated color nail, the player who activated the mechanic can challenge them. If the challenging player believes the current player can cover the designated color nail, the challenger can request to see the current player's hand. In the event the current player does have a play which can cover a designated color nail: the current player must cover the designated nail color and the current player is assigned two penalty nail cards, which count toward total nails at end of the game, as discussed below. In the event the current player does not have a play to cover a green nail, the challenging player receives a two nail penalty and must show their hand to the current player. In addition, the current player must discard one card tile at random, draw a card tile and must play that card tile.

In some exemplary implementations, such as a non-competitive format, players may decide to not enforce the Penalty Nails.

The Game enters its final round when there are no card tiles left in the Draw Deck and one player has no card tiles left in hand at the end of the player's turn. If the first player (e.g., the player to the left of the Dealer) goes out first, the remaining players have one last turn before the game ends. In this way, each of the players has the same number of rounds of play. Once all players have taken their last turn and the round has finished, the game ends.

In one exemplary implementation of the present invention, the winner is determined by counting each player's assigned indicia (e.g., red nails or green nails) visible on the Build Stack, remaining in the player's hand, and any penalty nails which the player received. In some implementations of the method of playing a game using a deck of card tiles, the player with the least number of their assigned indicia is the winner. In some other implementation, the player with the most number of their assigned indicia is the winner. Alternatively, a winner can be determined not by counting a number of indicia, but by the location or placement of indicia in the Build Stack and/or in the player's hand. The methods of play are not limited to any one particular objective or strategy and other methods of determining a winner are possible without departing from the spirit and scope of the present invention.

In some embodiments of the present invention, there are no ties. That is to say, in the event players have equal number of nails after all addition, according to some exemplary implementations, the players strategically remove one card tile from the Build Stack to subtract from their total nails and or add to their opponents' nail count. In some embodiments, players are allowed to look below a card tile to determine what, if any, images are covered by the card tile before removing the card tile from the Build Stack. In some other embodiments, a player must choose a card tile without first looking below the card tile. In other words, a player must remember what was previously covered by the card tile. In either event, the player who went out first, removes one card tile from the Build Stack of their choice. The remaining players, in clockwise order, remove one card tile from the Build Stack of their choice. The nails visible on the Build Stack, remaining in the player's hand, and any penalty nails which the player received are recounted and the player with the least amount of nails is the winner. In the event the first round of removal does not produce a winner, additional rounds of card tile removal are performed until a winner is produced.

In some other embodiments of the present invention, the card tiles are not square and divided into four squares but can be any number of possible shapes and divided into any number of subsections having any number of possible shapes and sizes. In such an arbitrarily shaped and divided set of card tiles, it is contemplated that each subsection of the card tile is either left blank or includes one of a number of indicia.

Figure 8:
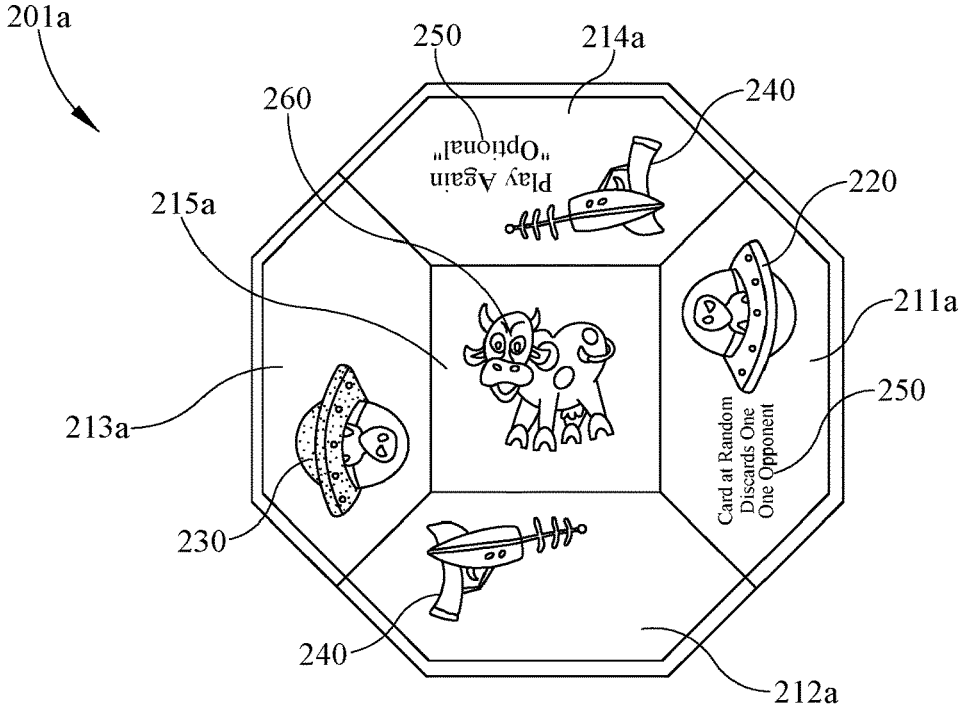
FIG. 8 is a plan view of one card tile of a second exemplary card tile deck of the present invention.

For example, and referring now to FIGS. 8-13, in a second exemplary card tile deck of the present invention, the card tile deck includes a plurality of card tiles having a substantially octagonal shape. With respect to FIG. 8, one exemplary card tile 201*a* is divided into a central zone 215*a* and four peripheral zones 211*a*, 212*a*, 213*a*, 214*a* which surround the central zone 215*a*. In particular, the central zone 215*a* has a square shape and each of the peripheral zones 211*a*, 212*a*, 213*a*, 214*a* has an irregular hexagonal shape. As shown in FIG. 8, each of the peripheral zones 211*a*, 212*a*, 213*a*, 214*a* includes one edge of the card, one half of an adjacent edge of the card, and one half of another adjacent edge of the card.

Figure 9:
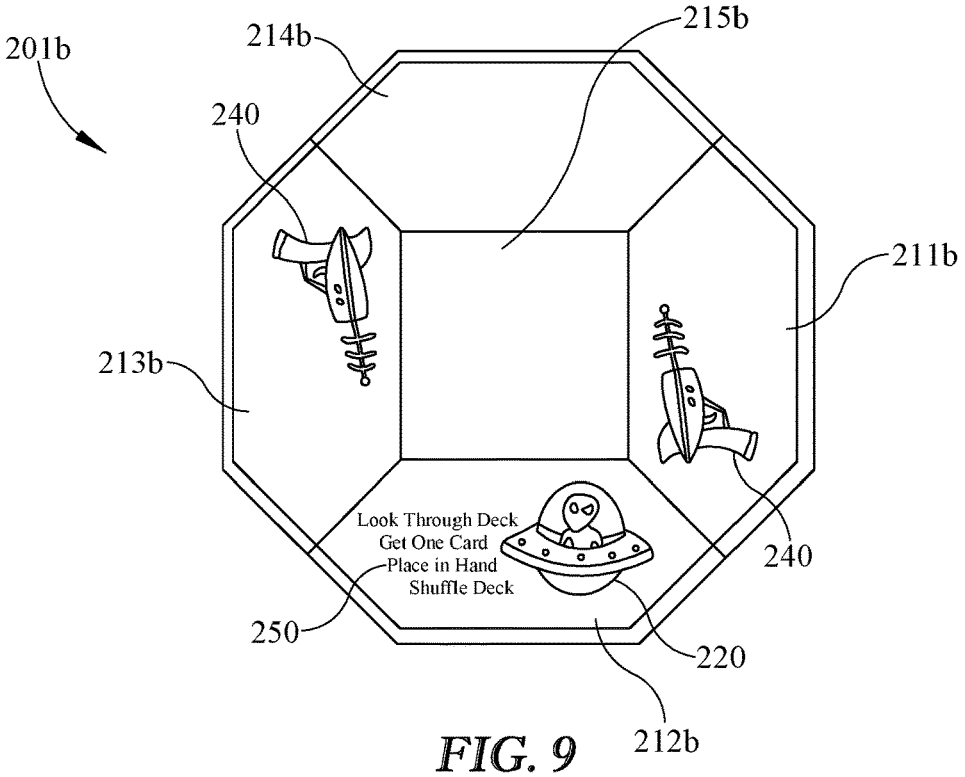
FIG. 9 is a plan view of another card tile of the second exemplary card tile deck of the present invention.
Figure 10:
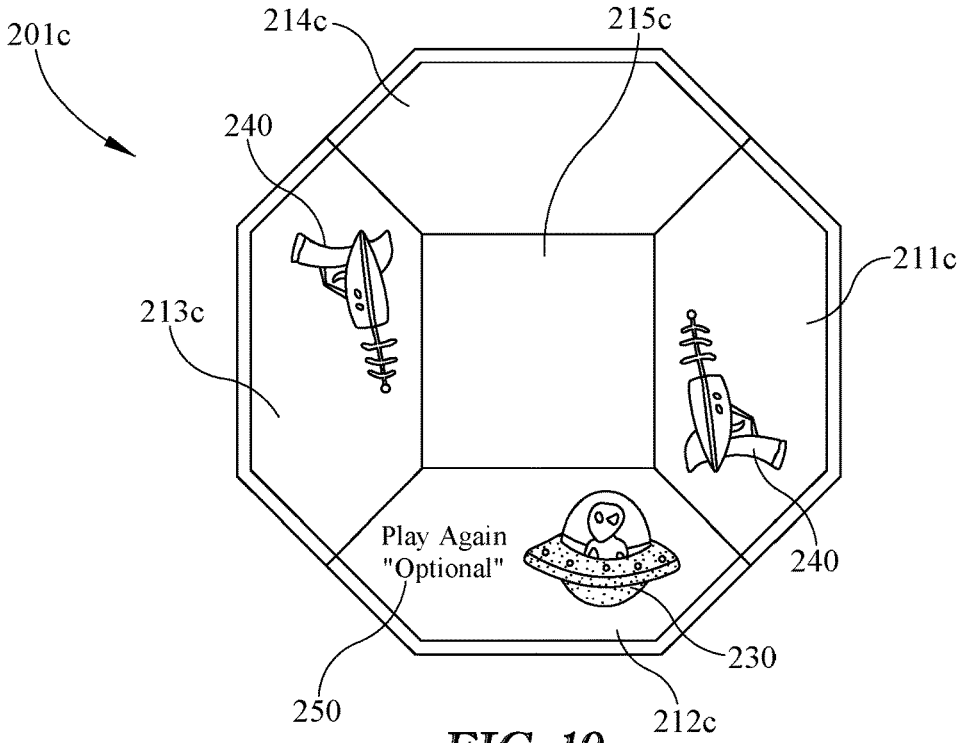
FIG. 10 is a plan view of another card tile of the second exemplary card tile deck of the present invention.
Figure 11:
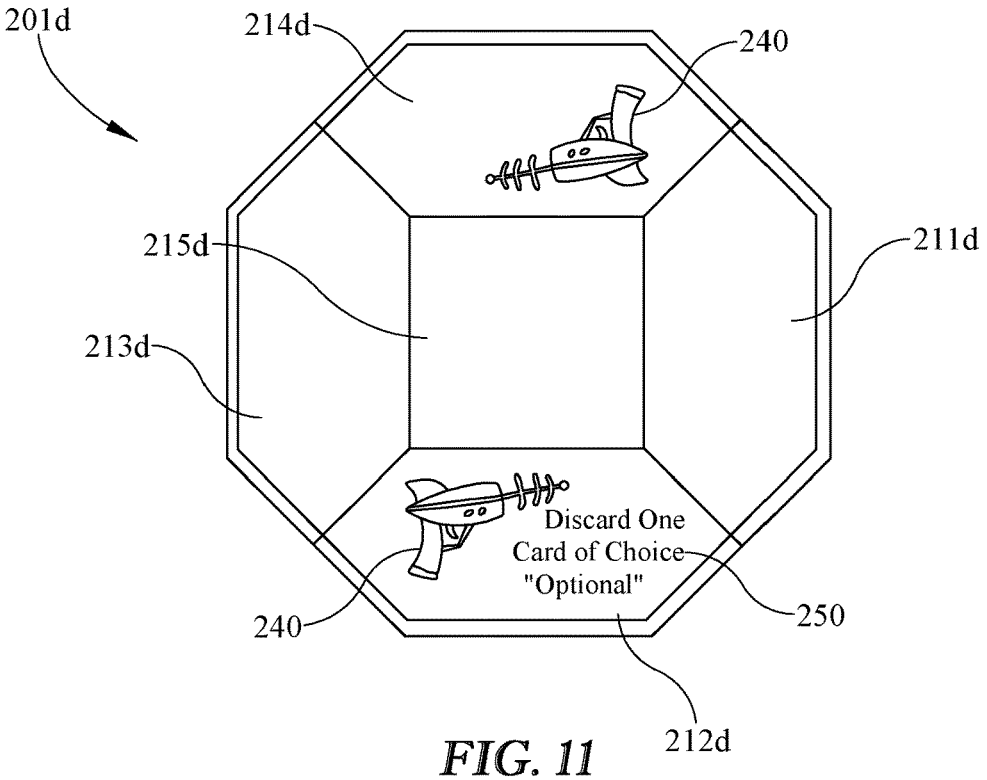
FIG. 11 is a plan view of another card tile of the second exemplary card tile deck of the present invention.

Similar to the four exemplary card tile 101*a* described above with respect to FIG. 1, each of the peripheral zones 211*a*, 212*a*, 213*a*, 214*a* of the exemplary card tile 201*a* includes either a first indicia 220, a second indicia 230, or a third indicia 240. As shown in FIGS. 9-11, each of the other exemplary card tiles 201*b*, 201*c*, 201*d* similarly includes a central zone surrounded by four peripheral zones one with similar numbering as the exemplary card tile 201*a* of FIG. 8. Furthermore, in each of the exemplary card tiles 201*b*, 201*c*, 201*d* shown in FIGS. 9-11, one or more of the peripheral zones includes either a first indicia 220, a second indicia 230, or a third indicia 240 but one or more of the zones includes no such indicia (i.e., includes a null indicia). Further still, and referring now to FIG. 8 in particular, in this exemplary deck of card tiles, one or more of the card tiles (e.g., the exemplary card tile 201*a* shown in FIG. 8) includes a fourth indicia 260 in the central zone 215*a*. In this exemplary embodiment, the first indicia 220 is a spaceship in a first color, such as red, the second indicia 230 is a spaceship in a second color, such as blue, the third indicia 240 is a laser gun, and the fourth indicia 260 is a cow. The exemplary card tiles 201*a*, 201*b*, 201*c*, 201*d* further include mechanics 250 in substantially the same manner as described above. FIGS. 8-11 show only four exemplary card tiles 201*a*, 201*b*, 201*c*, 201*d* of the card tile deck of the present invention, and the remaining card tiles comprising the card tile deck are similarly configured with various combinations of indicia and mechanics included in one or more of the zones.

An exemplary implementation of the method of playing a game with the exemplary card tile deck including card tiles represented by the exemplary card tiles 201*a*, 201*b*, 201*c*, 201*d* of FIGS. 8-11 operates in substantially the same manner as described above, with the exception of any effect of the fourth indicia 260, as discussed below.

Referring once again to FIG. 7, in a first step S10, players first choose a color corresponding to either the color of the first indicia (e.g., red spaceship) or the color of the second indicia (e.g., blue spaceship).

In a step S20, four card tiles are dealt to each player and the remainder of the card tiles are placed face down off to the side of the play area to form a Draw Deck.

Figure 12:
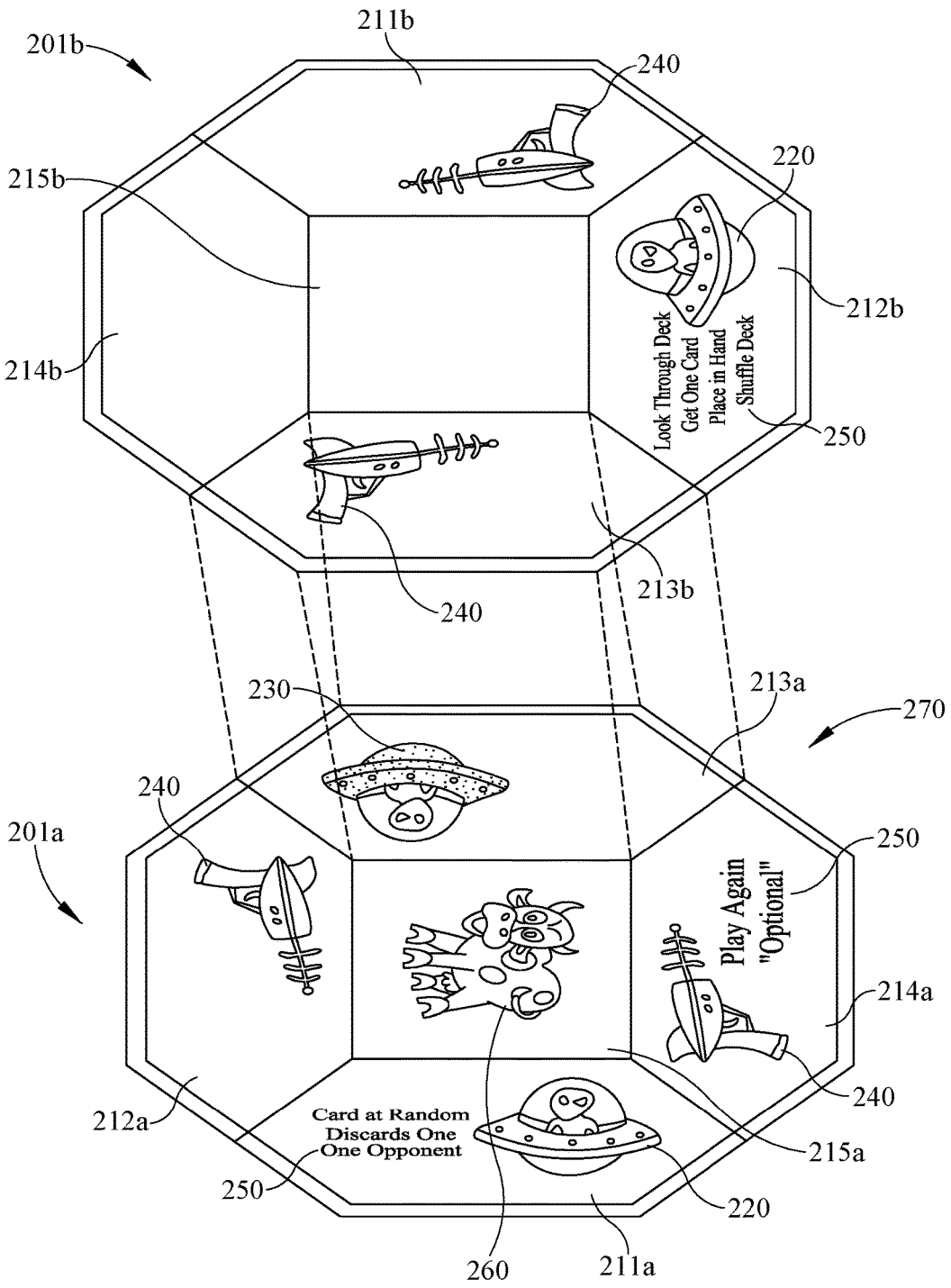
FIG. 12 is a perspective view of the card tile of FIG. 9 being positioned on top of a Build Stack formed from the single card tile of FIG. 8 according to an exemplary method of the present invention.
Figure 13:
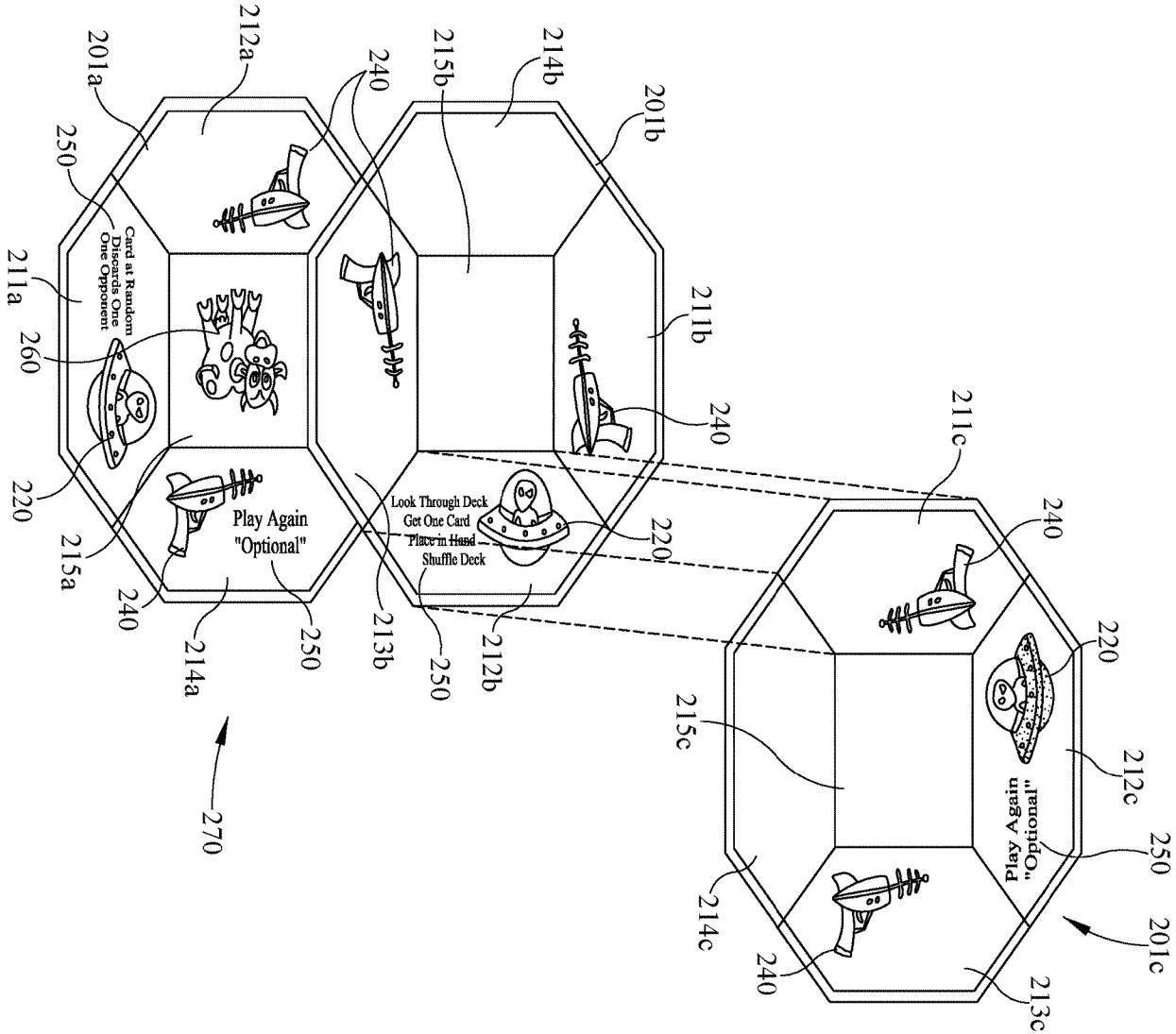
FIG. 13 is a perspective view of the card tile of FIG. 10 being positioned on top of the Build Stack formed from the card tiles of FIG. 8 and FIG. 9 according to an exemplary method of the present invention.

In a step S30, the top card tile of the Draw Deck is placed face up in the center of the play area and forms the base of a Build Stack which, during play, is built by positioning card tiles on top of the Build Stack. In a step S40, a player positions a card tile from the player's hand (i.e., an active card) on top of the previously played card tile which forms part of the Build Stack. For example, as shown in FIG. 12, a single played card tile 201*a* forms the base of the Build Stack 270 and an active card tile 201*b* is being positioned on top of the played card tile 201*a* with one of the zones 213*b* of the active card tile 201*b* substantially overlapping one of the zones 213*a* of the played card tile 201*a*. After the active card tile is positioned on top of the previously played card tile, the active card tile becomes part of the Build Stack. For example, as shown in FIG. 13, the Build Stack 270 now consists of the two previously played card tiles 201*a*, 201*b*.

The particular requirements and outcomes of placement of active card tiles on the Build Stack, are substantially the same as describe above with the substitution of the colored spaceships for the colored nails and the laser gun for the hammer. In particular, in the exemplary embodiment shown in FIGS. 8-13, blank zones (i.e., null indicia) can be covered by spaceships (i.e., first indicial or second indicia) or other blank zones (i.e., null indicia), spaceships (i.e., first indicial or second indicia) can be covered by laser guns (i.e., third indicia) or by blank zones (i.e., null indicia), and laser guns (i.e., third indicia) can only be covered by blank zones (i.e., null indicia). Any mechanics and penalties are handled in substantially the same manner as described above.

After the current player has placed the active card tile and all mechanics have resolved, in a step S50, the current player draws additional card tiles or discards card tiles to return the player's hand to four card tiles as described above. After the current player declares end of turn, the next player begins their turn and steps S40 and S50 are repeated. For example, as illustrated in FIG. 13, a second active card tile 201*c* is being positioned on top of the second played card tile 201*b* with one of the zones 211*c* of the active card tile 201*c* substantially overlapping one of the zones 212*b* of the played card tile 212*b*.

Of note, the octagonal shape of the exemplary card tiles represented by the card tiles 201*a*, 201*b*, 201*c*, 201*d* shown in FIGS. 8-13 allows for the central zone 215*a*, 215*b*, 215*c*, 215*d* of the card tiles 201*a*, 201*b*, 201*c*, 201*d* to remain exposed and visible throughout play. This makes it easier to identify which zones visible on the Build Stack belong to which of the played card tiles.

In some exemplary implementations of the method of playing a game with such a deck, a bonus point is awarded for each of the player's assigned indicia (e.g., red spaceship or blue spaceship) positioned next to a fourth indicia 260. As there are four possible positions for a player's indicia to be next to a central zone including a fourth indicia, there is a possibility of one, two, three, or four bonus points being awarded for each fourth indicia visible on the Build Stack. Likewise, each zone including a player's indicia can potentially be positioned next to two central zones including a fourth indicia. The winner is thus determined by counting each player's assigned indicia (e.g., red spaceship or blue spaceship) visible on the Build Stack, the number of bonus points awarded by adjacency of the player's indicia to a fourth indicia, the number of player's indicia remaining in the player's hand, and any penalty nails which the player received. Of course, a fourth indicia may have an effect other than providing a bonus point. For example, the fourth indicia may cause a penalty, or have some other predetermined effect at the end of the game or during play.

Of course, the set of card tiles of the present invention is not limited to any of the particular indicia described above, but can include any arbitrary indicia including numbers, letters, words, colors, shapes, images, etc., in various combinations. In fact, it is contemplated that in the set of card tiles of the present invention can, in some embodiments, include any number of images (e.g., four or more different images) in addition to blank zones. Furthermore, depending on the particular indicia used, exemplary play may differ regarding placement of the cards. For example, in a card tile deck including numbers, placement may require a mathematical relationship between overlapping and/or adjacent numbers, such as numbers both divisible by 3, or numbers which add to 5.

In another embodiment of the present invention, the set of card tiles is divided between the players, with one player taking all even numbered card tiles (based on the unique card number mentioned above) and the other player taking all odd numbered card tiles. The games follows the same rules, except each player has their own Draw Deck.

In another embodiment of the present invention, two teams of two players play the card tile game as discussed above, using substantially the same rules, except teammates must sit diagonal from each other. Play proceeds clockwise. Teammates are not allowed to discuss strategy, nor allowed to indicate an available placement. There is no cross talk during the game. In the event teammates discuss placement options or advise one another, the opposing team can assign a penalty per infraction. Player's turns are independent from their teammates, however decisions should be made for betterment of the team's outcome.

In another embodiment of the present invention, another exemplary set of card tiles is provided which includes indicia having more than two colors. Each player is assigned a particular color and the card tile game is played as discussed above, using substantially the same rules. For example, a first set of card tiles having green and red indicia is combined with a second set of card tiles having blue and yellow indicia. Four players then play the card tile game.

One of ordinary skill in the art will also recognize that additional embodiments and implementations are also possible without departing from the teachings of the present invention. This detailed description, and particularly the specific details of the exemplary embodiments and implementations disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. A method of playing a game comprising:

providing a card tile deck including a plurality of card tiles, each of the card tiles divided into multiple zones having substantially the same size and shape, with one or more of the zones including either a first indicia, a second indicia, a third indicia, or a null indicia;

dealing one or more of the plurality of card tiles to each of two or more players to form player hands;

placing one card tile of the plurality of card tiles down to begin a build stack of played card tiles; and continuing to form the build stack of played card tiles by repeatedly positioning an active card tile from the player hands on top of a played card tile of the build stack with only one of the zones of the active card tile substantially overlapping only one of the zones of the played card tile and not significantly overlapping any other zones of the played card tile;

wherein, each time the active card tile is positioned on the played card tile of the build stack, one of the following occurs:

(a) when the one zone of the active card tile substantially overlaps the one zone of the played card tile, if the one zone of the played card tile includes the null indicia, the one zone of the active card tile includes either the first indicia, the second indicia, or the null indicia;

(b) when the one zone of the active card tile substantially overlaps the one zone of the played card tile, if the one zone of the played card tile includes the first indicia or the second indicia, the one zone of the active card tile includes either the third indicia or the null indicia; or (c) when the one zone of the active card tile substantially overlaps the one zone of the played card tile, if the one zone of the played card tile includes the third indicia, the one zone of the active card tile includes the null indicia.

2. The method of claim 1, wherein, when the build stack of played card tiles includes multiple played card tiles, if the active card tile is positioned on top of more than one played card tile, only one of the zones of each of the more than one played card tile that the active card tile is positioned on top of is substantially overlapped by only one of the zones of the active card tile.

3. The method of claim 1, wherein, for some of the plurality of card tiles, one or more of the zones further includes instructions which describe an additional action; and wherein if the one of the zones of the played card tile includes instructions, the additional actions are performed when the one of the zones of the active card tile is positioned on top of the one of the zones of the played card tile.

4. The method of claim 3, wherein the instructions are only performed if the one of the zones of the played card tile includes the first indicia or the second indicia.

5. The method of claim 4, wherein the instructions are not performed if the one of the zones of the active card tile includes the null indicia.

6. The method of claim 1, wherein, for some of the plurality of card tiles, one or more of the zones further includes instructions which describe an additional action; and wherein if the one of the zones of the active card tile includes instructions, the additional actions are performed when the one of the zones of the active card tile is positioned on top of the one of the zones of the played card tile.

7. The method of claim 6, wherein the instructions are only performed if the one of the zones of the active card tile includes the third indicia.

8. The method of claim 7, wherein the instructions are not performed if the one of the zones of the played card tile includes the null indicia.

9. The method of claim 1, wherein upon positioning the active card tile on top of the played card tile, the active card tile becomes part of the build stack of played card tile.

10. A method of playing a game comprising:

providing a card deck including a plurality of cards, each of the cards having four non-overlapping zones having substantially the same size and shape where each of the zones is either blank, or includes either a first indicia, a second indicia, or a third indicia; and dealing one or more of the plurality of cards to each of two or more players to form player hands;

placing one card of the plurality of cards down to begin a build stack of played cards; and continuing to form the build stack of played cards by repeatedly positioning an active card from the player hands on top of a played card of the build stack with only one of the zones of the active card substantially overlapping only one of the zones of the played card and not significantly overlapping any other zones of the played card;

wherein the first indicia is an image in a first color, the second indicia is the same image in a second color, and the third indicia is another image different from the image of the first indicia and the image of the second indicia; and wherein, each time the active card is positioned on the played card, one of the following occurs:

(a) when the one zone of the active card substantially overlaps the one zone of the played card, if the one zone of the played card is blank, the one zone of the active card is either blank, or includes either the first indicia or the second indicia;

(b) when the one zone of the active card substantially overlaps the one zone of the played card, if the one zone of the played card includes the first indicia or the second indicia, the one zone of the active card is either blank, or includes the third indicia; or (c) when the one zone of the active card substantially overlaps the one of the zones of the played card, if the one zone of the played card includes the third indicia, the one zone of the active card is blank.

* * * * *